US009984805B2

(12) United States Patent
Kudo et al.

(10) Patent No.: US 9,984,805 B2
(45) Date of Patent: May 29, 2018

(54) INDUCTOR COMPONENT

(71) Applicant: Murata Manufacturing Co., Ltd., Kyoto (JP)

(72) Inventors: Hayami Kudo, Nagaokakyo (JP); Akinori Hamada, Nagaokakyo (JP); Shinji Otani, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days. days.

(21) Appl. No.: 15/369,073

(22) Filed: Dec. 5, 2016

(65) Prior Publication Data

US 2017/0169930 A1 Jun. 15, 2017

(30) Foreign Application Priority Data

Dec. 9, 2015 (JP) ..... 2015-240432

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 17/04*** | (2006.01) |
| ***H01F 27/29*** | (2006.01) |

(52) U.S. Cl.

CPC ..... *H01F 17/0013* (2013.01); *H01F 17/04* (2013.01); *H01F 27/292* (2013.01); *H01F 2017/048* (2013.01)

(58) Field of Classification Search

USPC ..... 336/200

See application file for complete search history.

(56) References Cited

U.S. PATENT DOCUMENTS

| | | | | |
|---|---|---|---|---|
| 6,373,368 | B1 * | 4/2002 | Shikama | H01F 41/04 29/605 |
| 9,236,171 | B2 * | 1/2016 | Ito | H01F 17/04 |
| 9,728,316 | B2 * | 8/2017 | Mimura | H01F 17/0006 |
| 2010/0157565 | A1 * | 6/2010 | Yoshida | H01F 27/292 361/811 |
| 2014/0191838 | A1 * | 7/2014 | Yoshida | H01F 17/0013 336/200 |

FOREIGN PATENT DOCUMENTS

JP 2013-225718 A 10/2013

* cited by examiner

*Primary Examiner* — Ronald Hinson

(74) *Attorney, Agent, or Firm* — Studebaker & Brackett PC

(57) ABSTRACT

An inductor component has a plurality of layers of spiral wirings a magnetic composite body directly or indirectly covering the plurality of layers of spiral wirings and made of a composite material of a resin and a metal magnetic powder with an average particle diameter of 5 μm or less an internal electrode embedded in the magnetic composite body with an end surface exposed from an outer surface of the magnetic composite body, the internal electrode being electrically connected to the spiral wirings, and an external terminal disposed on the outer surface of the magnetic composite body and electrically connected to the internal electrode.

11 Claims, 10 Drawing Sheets

INDUCTOR COMPONENT

CROSS REFERENCE TO RELATED APPLICATIONS

This application claims benefit of priority to Japanese Patent Application 2015-240432 filed Dec. 9, 2015, the entire content of which is incorporated herein by reference.

TECHNICAL FIELD

The present disclosure relates to an inductor component.

BACKGROUND

A conventional inductor component is described in Japanese Laid-Open Patent Publication No. 2013-225718. This inductor component has a glass epoxy substrate, spiral wirings disposed on both surfaces of the glass epoxy substrate, an insulating resin covering the spiral wirings, and a core covering the upper and lower sides of the insulating resin. The core is a metal magnetic powder containing resin and the core contains a metal magnetic powder having an average particle diameter of 20 to 50 μm.

SUMMARY

Problem to be Solved by the Disclosure

As the power-saving techniques are increasingly demanded in association with the increase in performance of PCs and servers and the spread of mobile devices, an IVR (Integrated Voltage Regulator) technique is attracting attention as a technique of reducing power consumption of a CPU (Central Processing Unit).

In a conventional system, as shown in FIG. 5, a voltage is supplied from a power source 105 through one VR (Voltage Regulator) 103 to N CPUs 101 in an IC (integrated circuit) chip 100.

On the other hand, as shown in FIG. 6, a system of the IVR technique includes individual VRs 113 adjusting a voltage from the power source 105 for respective CPUs 101 and individually controls voltages supplied to the CPUs 101 in accordance with the clock operation frequencies of the CPUs 101.

To control supply voltages in accordance with changes in operation frequency of the CPUs 101, the supply voltages must be changed at high speed, and the VRs 113 require a chopper circuit performing a high-speed switching operation of 10 to 100 MHz.

Accordingly, for an inductor used for an output-side ripple filter of the chopper circuit, a high-frequency power inductor is required that is capable of adapting to the high-speed switching operation of 10 to 100 MHz and applying electric power at a level of several amperes as a sufficient current to a core for operation of the CPUs 101.

Additionally, since it is also intended in the IVR to integrate the system described above with an IC chip 110 so as to achieve a power saving and a reduction in size at the same time, a small-sized high-frequency power inductor is required that can be built into an IC package. Particularly, the advancement in miniaturization of a system through three-dimensional mounting such as SiP (System in Package) and PoP (Package on Package) necessitates, for example, a thin high-frequency power inductor having a thickness of 0.33 mm or less capable of being built into an IC package substrate or being mounted on the BGA (Ball Grid Array) side of the substrate.

However, since a conventional inductor component has spiral wirings disposed on both surfaces of a glass epoxy substrate, the thickness of the glass epoxy substrate becomes an inhibiting factor and makes it difficult to achieve a thinner component. The glass epoxy substrate has at least a thickness of about 80 μm because of the limit of thickness of glass cloth and, therefore, an inter-layer pitch of two layers of the spiral wirings can no longer be reduced. If the substrate is forcibly made thinner, the strength of the substrate cannot be kept and the wiring processing, etc., becomes difficult.

Because the core contains a metal magnetic powder having an average particle diameter of 20 to 50 μm, the size of the metal magnetic powder is large. This leads to an increased thickness of the core above and below the insulating resin and makes it difficult to achieve a thinner component. Additionally, for example, to allow the insulating resin covering the spiral wirings to contain the metal magnetic powder so as to improve the L-value, a wiring pitch must be ensured to be sufficiently larger than the average particle diameter of the metal magnetic powder, which makes it difficult to achieve a smaller size.

Therefore, the present inventors are currently considering an inductor component capable of achieving reductions in height and size. This inductor component has spiral wirings, an insulator covering the spiral wirings, a magnetic composite body covering the insulator and made of a composite material of a resin and a metal magnetic powder, and an internal electrode that is embedded in the magnetic composite body with an end surface exposed from an outer surface of the magnetic composite body and that is electrically connected to the spiral wirings.

However, it is found that the mounting stability of the inductor component is reduced in some cases when this inductor component is mounted. Specifically, this inductor component has an exposed end surface of the internal electrode acting as an external terminal and, if the area of the end surface of the internal electrode is smaller relative to the width of the inductor component, the posture of the inductor component may become unstable when the end surface of the internal electrode is bonded by solder. On the other hand, if the area of the end surface of the internal electrode is made larger, the volume of the magnetic composite body is accordingly reduced, causing a problem of characteristic degradation.

Therefore, a problem to be solved by the present disclosure is to provide an inductor component capable of improving the mounting stability without characteristic degradation.

Solutions to the Problems

To solve the problem, the present disclosure provides an inductor component comprising:

a plurality of layers of spiral wirings;

a magnetic composite body directly or indirectly covering the plurality of layers of spiral wirings and made of a composite material of a resin and a metal magnetic powder with an average particle diameter of 5 μm or less;

an internal electrode embedded in the magnetic composite body with an end surface exposed from an outer surface of the magnetic composite body, the internal electrode being electrically connected to the spiral wirings; and an external terminal disposed on the outer surface of the magnetic composite body and electrically connected to the internal electrode, wherein the external terminal includes a metal film contacting the resin and the metal magnetic powder of the magnetic composite body as well as the end surface of the internal electrode, and the metal film has an area on the end surface side larger than the area of the end surface.

According to the inductor component of the present disclosure, the external terminal includes a metal film contacting the resin and the metal magnetic powder of the magnetic composite body as well as the end surface of the internal electrode, and the metal film has an area on the end surface side larger than the area of the end surface. As a result, the area of the external terminal bonded to solder can be made larger relative to the width of the inductor component and, when the external terminal is bonded by solder, the posture of the inductor component becomes stable so that the mounting stability of the inductor component can be improved. The mounting stability is improved without the need of increasing the area of the end surface of the internal electrode and the magnetic composite body can be restrained from being reduced in volume so as to prevent characteristic degradation.

In an embodiment of the inductor component, the external terminal has the metal film and a coating film covering the metal film.

According to the embodiment, since the external terminal has the metal film and a coating film covering the metal film, for example, by using a (low-resistance) material having a low electric resistance for the metal film and using a material with high solder leach resistance and solder wettability for the coating film, the external terminal is improved in design freedom in such a manner that external terminals excellent in conductivity, reliability, and solder bondability can be constructed.

In an embodiment of the inductor component, the metal film of each of a plurality of external terminals is disposed on a first surface of the magnetic composite body, and a resin film is disposed on a portion without the metal film on the first surface of the magnetic composite body.

According to the embodiment, since a resin film is disposed on a portion without the metal film on the first surface of the magnetic composite body, the insulation between the multiple metal films (external terminals) can be improved. Additionally, the resin film is substituted for a mask at the time of pattern formation of the metal film, so that the manufacturing efficiency is improved. The resin film covers the metal magnetic powder exposed from the resin and therefore can prevent the metal magnetic powder from being exposed to the outside.

In an embodiment of the inductor component, the external terminal is protruded further than the resin film to the side opposite to the first surface.

According to the embodiment, since the external terminal is protruded further than the resin film, when the external terminal is mounted, the mounting stability can be improved.

In an embodiment of the inductor component, the resin film contains a filler made of an insulating material.

According to the embodiment, since the resin film contains a filler made of an insulating material, the insulation between the external terminals can be improved.

In an embodiment of the inductor component, the thickness of the metal film is equal to or less than ⅕ of the thickness of the spiral wirings.

According to the embodiment, since the thickness of the metal film is equal to or less than ⅕ of the thickness of the spiral wirings and is sufficiently thinner than the spiral wiring, the inductor component can be reduced in height.

In an embodiment of the inductor component, the thickness of the metal film is 1 μm or more and 10 μm or less.

According to the embodiment, since the thickness of the metal film is 1 μm or more and 10 μm or less, the inductor component can be reduced in height.

In an embodiment of the inductor component, the material of the metal film and the material of the internal electrode are the same kind of metal.

According to the embodiment, since the material of the metal film and the material of the internal electrode are the same kind of metal, the connection reliability can be improved.

In an embodiment of the inductor component, the magnetic composite body has a recess in a portion of the outer surface, and the metal film is filled into the recess.

According to the embodiment, since the metal film is filled into the recess of the magnetic composite body, the adhesion between the metal film and the magnetic composite body can be improved.

In an embodiment of the inductor component, the metal film goes around along an outer surface of the metal magnetic powder to the inner side of the magnetic composite body.

According to the embodiment, since the metal film goes around along an outer surface of the metal magnetic powder to the inner side of the magnetic composite body, the metal film is firmly bonded to the metal magnetic powder because of an increase in area of contact with the metal magnetic powder, and the anchor effect can be produced because of the contact with the magnetic composite body along the shape of the recess, so that the adhesion between the metal film and the magnetic composite body can be improved.

Effect of the Disclosure

According to the inductor component of the present disclosure, since the external terminal includes the metal film contacting the resin and the metal magnetic powder of the magnetic composite body as well as the end surface of the internal electrode and the metal film has an area on the end surface side larger than the area of the end surface, the mounting stability can be improved without characteristic degradation.

DETAILED DESCRIPTION

Modes for Carrying Out the Disclosure

The present disclosure will now be described in detail with reference to shown embodiments.

First Embodiment

Figure 1:
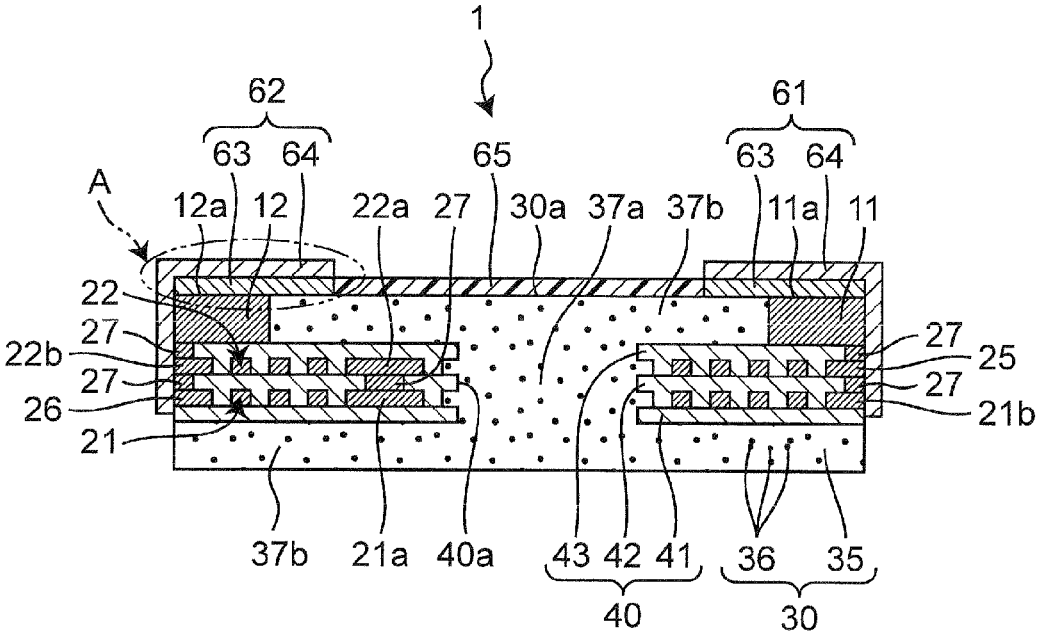
FIG. 1 is a cross-sectional view of a first embodiment of an inductor component of the present disclosure.

FIG. 1 is a cross-sectional view of a first embodiment of an inductor component of the present disclosure. The drawings are schematically drawn and may be different in relationships of scales and dimensions of members from actual relationships. The inductor component 1 is mounted on an electronic device such as a personal computer, a DVD player, a digital camera, a TV, a portable telephone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIG. 1, the inductor component 1 has a plurality of layers of spiral wirings 21, 22, an insulator 40 including a plurality of insulating layers 41 to 43 laminated alternately with the plurality of layers of the spiral wirings 11, 12, a magnetic composite body 30 covering the insulator 40, first and second internal electrodes 11, 12 embedded in the magnetic composite body 30 and electrically connected to the first and second spiral wirings 21, 22, and first and second external terminals 61, 62 disposed on an outer surface of the magnetic composite body 30 and electrically connected to the first and second internal electrodes 11, 12. Covering an object in this case means covering at least a portion of the object.

The first and second spiral wirings 21, 22 are arranged in order from a lower layer to an upper layer. In this description, the upper and lower sides of the inductor component 1 are assumed to be identical to the upper and lower sides on the plane of FIG. 1. The first and second spiral wirings 21, 22 are electrically connected in a lamination direction. The lamination direction refers to the direction of lamination of layers and specifically means a direction along the up-down direction on the plane of FIG. 1.

The first and second spiral wirings 21, 22 are each formed into a spiral shape on a planar surface. The first spiral wiring 21 is formed into a spiral shape swirling clockwise and away from the center when viewed from above, for example. The second spiral wiring 22 is formed into a spiral shape swirling counterclockwise and away from the center when viewed from above, for example.

The first and second spiral wirings 21, 22 are made of low-resistance metal, for example, Cu, Ag, or Au. Preferably, low-resistance and narrow-pitch spiral wirings can be formed by using Cu plating formed by a semi-additive method.

The first and second internal electrodes 11, 12 are disposed on the upper side in the lamination direction of the first and second spiral wirings 21, 22. The first and second internal electrodes 11, 12 are embedded in the magnetic composite body 30 such that the upper end surfaces 11*a*, 12*a* of the first and second internal electrodes 11, 12 are exposed from an upper end surface (first surface) 30*a* on the exterior of the magnetic composite body 30. It is assumed that this exposure includes not only the exposure to the outside of the inductor component 1 but also the exposure to another member, i.e., the exposure at a boundary surface to another member.

The first internal electrode 11 is electrically connected to the first spiral wiring 21, and the second internal electrode 12 is electrically connected to the second spiral wiring 22. The internal electrodes 11, 12 are made of the same material as the spiral wirings 21, 22, for example.

The insulator 40 is made of a composite material of an inorganic filler and a resin. The resin is an organic insulating material made of epoxy-based resin, bismaleimide, liquid crystal polymer, or polyimide, for example. The inorganic filler has an average particle diameter of 5 μm or less. The inorganic filler is an insulator such as $SiO_2$. Preferably, the inorganic filler has an average particle diameter of 0.5 μm or less and is made of $SiO_2$. Preferably, the content percentage of the inorganic filler is 20 vol % or more and 70 vol % or less relative to the insulator 40. The insulator 40 is not limited to the composite material and may be made only of a resin.

The insulator 40 is made up of first to third insulating layers 41 to 43. The first to third insulating layers 41 to 43 are arranged in order from a lower layer to an upper layer. The first spiral wiring 21 is laminated on the first insulating layer 41. The second insulating layer 42 is laminated on the first spiral wiring 21 to cover the first spiral wiring 21. The second spiral wiring 22 is laminated on the second insulating layer 42. The third insulating layer 43 is laminated on the second spiral wiring 22 to cover the second spiral wiring 22. In this way, the first and second spiral wirings 21, 22 and a plurality of insulating layers are alternately laminated. In other words, each of the first and second spiral wirings 21, 22 is laminated on an insulating layer and covered by an insulating layer above the insulating layer.

The second spiral wiring 22 is electrically connected through a via wiring 27 extending in the lamination direction to the first spiral wiring 21. The via wiring 27 is disposed in the second insulating layer 42. An inner circumferential portion 21*a* of the first spiral wiring 21 and an inner circumferential portion 22*a* of the second spiral wiring 22 are electrically connected through the via wiring 27. As a result, the first spiral wiring 21 and the second spiral wiring 22 constitute one inductor.

An outer circumferential portion 21*b* of the first spiral wiring 21 and an outer circumferential portion 22*b* of the second spiral wiring 22 are located on both end sides of the insulator 40 when viewed in the lamination direction. The first internal electrode 11 is located on the outer circumferential portion 21*b* side of the first spiral wiring 21, and the second internal electrode 12 is located on the outer circumferential portion 22*b* side of the second spiral wiring 22.

The outer circumferential portion 21*b* of the first spiral wiring 21 is electrically connected to the first internal electrode 11 through a via wiring 27 disposed in the second insulating layer 42, a first connection wiring 25 disposed on the second insulating layer 42, and a via wiring 27 disposed in the third insulating layer 43. The outer circumferential portion 22*b* of the second spiral wiring 22 is electrically connected through a via wiring 27 disposed in the third insulating layer 43 to the second internal electrode 12. The outer circumferential portion 22*b* of the second spiral wiring 22 is electrically connected through a via wiring 27 disposed in the second insulating layer 42 to a second connection wiring 26 disposed on the first insulating layer 41. The first connection wiring 25 and the second spiral wiring 22 are not connected, and the second connection wiring 26 and the first spiral wiring 21 are not connected.

The first and second spiral wirings 21, 22 each have a thickness of 40 μm or more and, preferably, 120 μm or less, in a height direction. The height direction is a direction along the up-down direction of the inductor component 1. The first and second spiral wirings 21, 22 each have a wiring pitch of 10 μm or less and, preferably, 3 μm or more. The spiral wirings have an inter-layer pitch of 10 μm or less and, preferably, 3 μm or more. The wiring pitch and the inter-layer pitch are design values and have manufacturing variations of ±approx. 20%.

By setting the wiring thickness to 40 μm or more, a DC resistance can sufficiently be reduced. By setting the wiring thickness to 120 μm or less, a wiring aspect ratio defined as a ratio of thicknesses in the height and width directions of the wiring can be prevented from becoming extremely large so as to suppress process variations. By setting the wiring pitch to 10 μm or less, a wiring width can be made larger and the DC resistance can certainly be reduced. By setting the wiring pitch to 3 μm or more, the insulation between the wirings can sufficiently be ensured. By setting the inter-layer pitch to 10 μm or less, a reduced height can be achieved. By setting the inter-layer pitch to 3 μm or more, an inter-layer short can be suppressed.

The number of turns of the inductor made up of the first and second spiral wirings 21, 22 is one or more and ten or less, preferably, 1.5 or more and 5 or less.

The magnetic composite body 30 is made up of a composite material of a resin 35 and a metal magnetic powder 36. The resin 35 is an organic insulating material made of an epoxy-based resin, bismaleimide, liquid crystal polymer, or polyimide, for example. The metal magnetic powder 36 has an average particle diameter of 0.1 μm or more and 5 μm or less, for example. The average particle diameter in this case is calculated as is the case with an average particle diameter of crystals of a metal film described later. During manufacturing processes of the inductor component 1, the average particle diameter of the metal magnetic powder 36 can be calculated as a particle diameter corresponding to 50% of an integrated value in particle size distribution obtained by a laser diffraction/scattering method. The metal magnetic powder 36 is made of, for example, an FeSi alloy such as FeSiCr, an FeCo alloy, an Fe alloy such as NiFe, or an amorphous alloy thereof. The content percentage of the metal magnetic powder 36 is, preferably, 20 vol % or more and 70 vol % or less relative to the magnetic composite body 30.

The magnetic composite body 30 has an inner magnetic path 37*a* and an outer magnetic path 37*b*. The inner magnetic path 37*a* is located in the inner diameters of the first and second spiral wirings 21, 22 and an inner diameter hole portion 40*a* of the insulator 40. The outer magnetic path 37*b* is located above and below the first and second spiral wirings 21, 22 and the insulator 40.

The first and second external terminals 61, 62 are disposed on the upper end surface 30*a* side of the magnetic composite body 30. The first and second external terminals 61, 62 each have a metal film 63 and a coating film 64 covering the metal film 63. The metal film 63 is in contact with the upper end surface 30*a* of the magnetic composite body 30. The coating film 64 extends from the upper surface of the metal film 63 toward the side surface of the magnetic composite body 30. The coating film 64 of the first external terminal 61 is in contact with a side surface of the first internal electrode 11, a side surface of the via wiring 27, a side surface of the first connection wiring 25, and the outer circumferential portion 21*b* of the first spiral wiring 21. The coating film 64 of the second external terminal 62 is in contact with a side surface of the second internal electrode 12, a side surface of the via wiring 27, a side surface of the second connection wiring 26, and the outer circumferential portion 22*b* of the second spiral wiring 22.

The metal film 63 is made of, for example, low-resistance metal such as Cu, Ag, and Au. The material of the metal film 63 is, preferably, the same kind of metal as the material of the internal electrodes 11, 12 and, in this case, the connection reliability can be improved between the metal film 63 and the internal electrodes 11, 12. As described later, the metal film 63 is preferably formed by electroless plating. The metal film 63 may be formed by electrolytic plating, sputtering, or vapor deposition. The coating film 64 is made up of, for example, a material with high solder leach resistance and solder wettability such as SnNi, and is formed by plating from the upper surface of the metal film 63 toward the side surface of the magnetic composite body 30. As described above, since the first and second external terminals 61, 62 each have the metal film 63 and the coating film 64 covering the metal film 63, the metal film 63 can be made of a low-resistance material and the coating film 64 can be made of a material with high solder leach resistance and solder wettability as described above, for example. Therefore, the external terminals 61, 62 are improved in design freedom in such a manner that the external terminals 61, 62 excellent in conductivity, reliability, and solder bondability can be constructed.

On the other hand, the coating film 64 may be made of the same material as the metal film 63 and, for example, the metal film 63 may be a layer of Cu formed by electroless plating and the coating film 64 may be a layer of Cu formed by the electrolytic plating. In this case, since the low-resistance coating film 64 covers the side surface of the inductor component 1, the side surface can be solder-bonded. The coating film 64 may have a lamination structure and may have, for example, a configuration having a surface of a layer of Cu covered with a layer of SnNi, etc. Moreover, the coating film 64 is not an essential constituent element and the coating film 64 may not be included.

Figure 2:
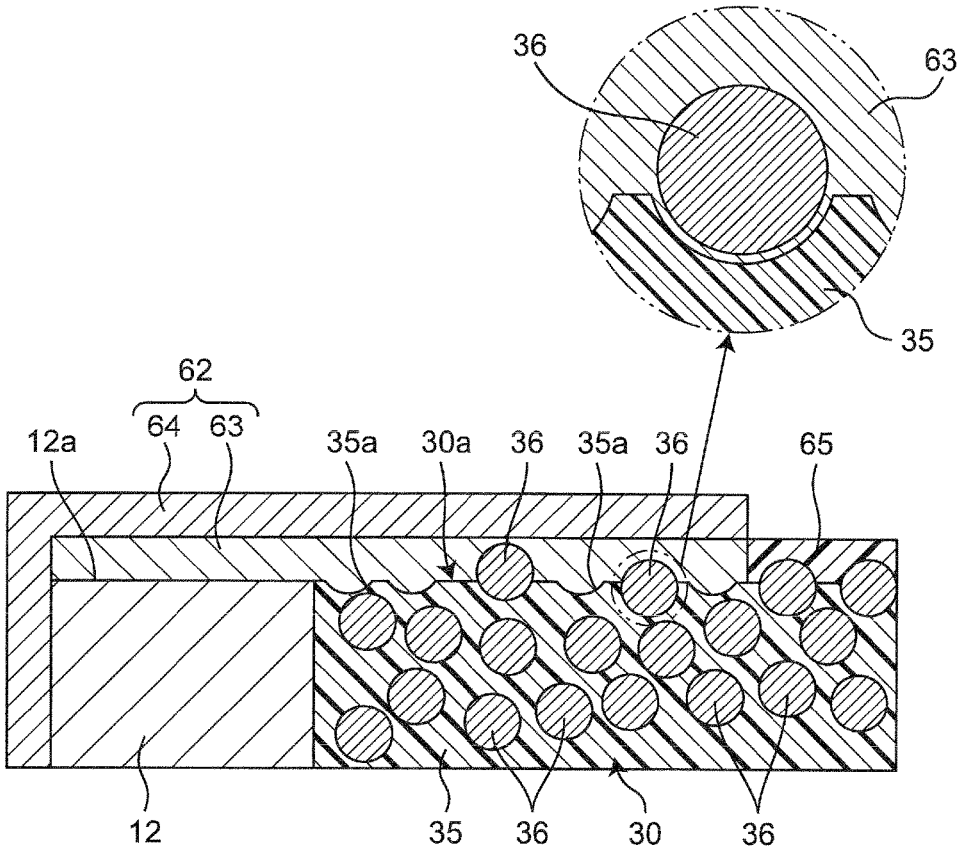
FIG. 2 is an enlarged view of a portion A of FIG. 1.

FIG. 2 is an enlarged view of a portion A of FIG. 1. As shown in FIGS. 1 and 2, the metal film 63 of the second external terminal 62 is in contact with the resin 35 and the metal magnetic powder 36 of the magnetic composite body 30 as well as the end surface 12*a* of the second internal electrode 12. The metal film 63 of the second external terminal 62 has an area on the end surface 12*a* side larger than the area of the end surface 12*a*. The metal film 63 of the first external terminal 61 is formed in the same way as the metal film 63 of the second external terminal 62.

The upper end surface 30*a* of the magnetic composite body 30 is a ground surface formed by grinding. Therefore, on the upper end surface 30*a*, the metal magnetic powder 36 is exposed from the resin 35. The magnetic composite body 30 has recesses 35*a* in the resin 35 portion formed partially in the upper end surface 30*a* by shedding of particles of the metal magnetic powder 36 during grinding.

Particularly, the metal film 63 is filled into the recesses 35*a* of the resin 35. This produces the anchor effect so that the adhesion between the metal film 63 and the magnetic composite body 30 can be improved. Additionally, as described later, the metal film 63 goes around along the outer surface of the metal magnetic powder 36 to the inner side of the magnetic composite body 30. In particular, the metal film 63 penetrates along the outer surface of the metal magnetic powder 36 into a gap between the resin 35 and the metal magnetic powder 36. As a result, the metal film 63 is firmly bonded to the metal magnetic powder 36 because of an increase in area of contact with the metal magnetic powder 36, and the anchor effect can be produced because of the contact with the magnetic composite body 30 along the shape of the recesses 35*a* of the resin 35, so that the adhesion between the metal film 63 and the magnetic composite body 30 can be improved. To fill the metal film 63 into the recesses 35*a*, for example, the metal film 63 may be formed by electroless plating as described later. The recesses 35*a* may not entirely be filled with the metal film 63 and may partially be filled with the metal film 63.

The thickness of the metal film 63 is equal to or less than ⅕ of the thickness of each of the first and second spiral wirings 21, 22. Specifically, the thickness of the metal film 63 is 1 μm or more and 10 μm or less. As a result, the inductor component 1 can be reduced in height. Since the metal film 63 has a thickness of 1 μm or more, the metal film 63 can favorably be manufactured and, since the metal film 63 has a thickness of 10 μm or less, the inductor component 1 can be reduced in height.

A resin film 65 is disposed on a portion without the metal film 63 on the upper end surface 30*a* of the magnetic composite body 30. For example, the resin film 65 is made of a highly electrically insulating resin material such as an acrylic resin, an epoxy-based resin, and polyimide. As a result, the insulation between the first and second external terminals 61, 62 (the metal films 63) can be improved. Additionally, the resin film 65 is substituted for a mask at the time of pattern formation of the metal film 63, so that the manufacturing efficiency is improved. The resin film 65 covers the metal magnetic powder 36 exposed from the resin 35 and therefore can prevent the metal magnetic powder 36 from being exposed to the outside.

The first and second external terminals 61, 62 protrude further than the resin film 65 to the side opposite to the upper end surface 30*a*. In other words, the thickness of the first and second external terminals 61, 62 is larger than the film thickness of the resin film 65 and, as a result, when the first and second external terminals 61, 62 are mounted, the mounting stability can be improved.

The resin film 65 may contain filler made of an insulating material. As a result, the insulation between the first and second external terminals 61, 62 can be improved.

A method of manufacturing the inductor component 1 will be described.

Figure 3A:
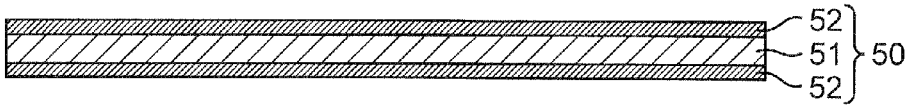
FIG. 3A is an explanatory view for explaining a manufacturing method of the inductor component.

As shown in FIG. 3A, a base 50 is prepared. The base 50 has an insulating substrate 51 and base metal layers 52 disposed on both sides of the insulating substrate 51. In this embodiment, the insulating substrate 51 is a glass epoxy substrate and the base metal layers 52 are Cu foils. Since the thickness of the base 50 does not affect the thickness of the inductor component 1 because the base 50 is peeled off as described later, the base with easy-to-handle thickness may be used as needed for the reason of warpage due to processing, etc.

Figure 3B:
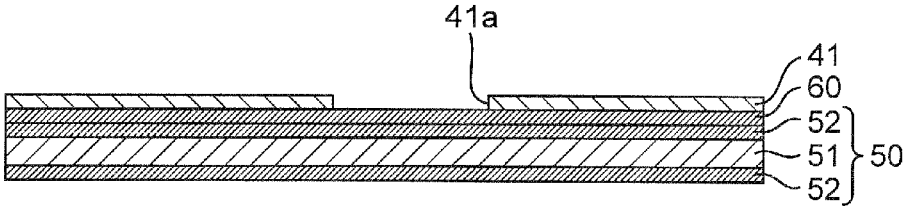
FIG. 3B is an explanatory view for explaining a manufacturing method of the inductor component.

As shown in FIG. 3B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to a smooth surface of the base metal layer 52. Therefore, an adhesion force can be made weak between the dummy metal layer 60 and the base metal layer 52 and, at a subsequent step, the base 50 can easily be peeled from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the first insulating layer 41 is laminated on the dummy metal layer 60 temporarily bonded to the base 50. In this case, the first insulating layer 41 is thermally press-bonded and thermally cured by a vacuum laminator, a press machine, etc. Subsequently, a portion of the first insulating layer 41 corresponding to the inner magnetic path (magnetic core) is removed by a laser, etc., to form an opening portion 41*a*.

Figure 3C:
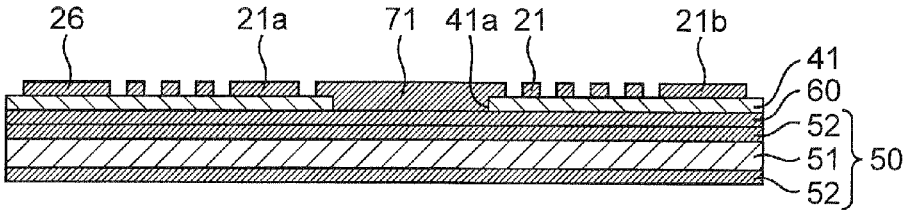
FIG. 3C is an explanatory view for explaining a manufacturing method of the inductor component.

As shown in FIG. 3C, the first spiral wiring 21 and the second connection wiring 26 are laminated on the first insulating layer 41 by using the semi-additive method. The first spiral wiring 21 and the second connection wiring 26 are not in contact with each other. The second connection wiring 26 is disposed on the side opposite to the outer circumferential portion 21*b*. Specifically, first, a power feeding film is formed on the first insulating layer 41 by electroless plating, sputtering, vapor deposition, etc. After formation of the power feeding film, a photosensitive resist is applied or pasted onto the power feeding film, and a wiring pattern is formed by photolithography. Subsequently, a metal wiring corresponding to wirings 21, 26 is formed by the electrolytic plating. After the formation of the metal wiring, the photosensitive resist is peeled and removed by a chemical liquid, and the power feeding film is etched and removed. It is noted that this metal wiring can subsequently be used as a power feeding portion to acquire the wirings 21, 26 with narrower spaces by performing additional Cu electrolytic plating. In this embodiment, for example, after a Cu wiring with L (wiring width)/S (wiring space (wiring pitch))/t (wiring thickness) of 50/30/60 μm is formed by the semi-additive method, additional Cu electrolytic plating can be performed for the thickness of 10 μm to acquire a wiring with L/S/t=70/10/70 μm. A first sacrifice conductor 71 corresponding to the inner magnetic path is disposed by using the semi-additive method on the dummy metal layer 60 in the opening portion 41*a* of the first insulating layer 41.

Figure 3D:
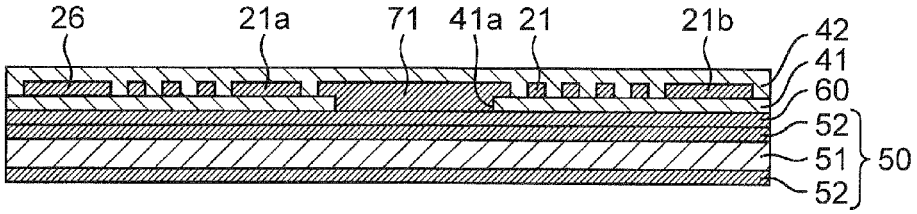
FIG. 3D is an explanatory view for explaining a manufacturing method of the inductor component.

As shown in FIG. 3D, the second insulating layer 42 is laminated to the first spiral wiring 21, the second connection wiring 26, and the first sacrifice conductor 71 to cover the first spiral wiring 21, the second connection wiring 26, and the first sacrifice conductor 71 with the second insulating layer 42. The second insulating layer 42 is then thermally press-bonded and thermally cured by a vacuum laminator, a press machine, etc. In this case, the thickness of the second insulating layer 42 above the first spiral wiring 21 is set to 10 μm or less. As a result, the inter-layer pitch between the first and second spiral wirings 21, 22 can be set to 10 μm or less.

To ensure a filling property to the wiring pitch (e.g., 10 μm) of the first spiral wiring 21, the inorganic filler (insulator) included in the second insulating layer 42 must have a particle diameter sufficiently smaller than the wiring pitch of the first spiral wiring 21. Additionally, to achieve a thinner component, the inter-layer pitch to the subsequent upper wiring must be made as thin as 10 μm or less, for example, and therefore, also the insulator must have a sufficiently small particle diameter.

Figure 3E:
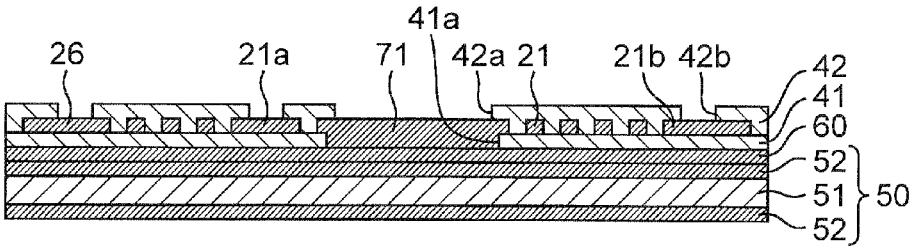
FIG. 3E is an explanatory view for explaining a manufacturing method of the inductor component.

As shown in FIG. 3E, a via hole 42*b* for filling the via wiring 27 is formed in the second insulating layer 42 by laser processing, etc. A portion of the second insulating layer 42 corresponding to the inner magnetic path (magnetic core) is removed by a laser, etc., to form an opening portion 42*a*.

Figure 3F:
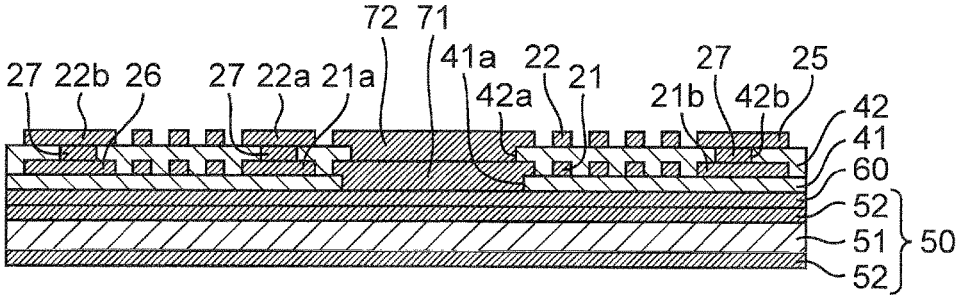
FIG. 3F is an explanatory view for explaining a manufacturing method of the inductor component.

As shown in FIG. 3F, the via hole is filled with the via wiring 27, and the second spiral wiring 22 and the first connection wiring 25 are laminated on the second insulating layer 42. The second spiral wiring 22 and the first connection wiring 25 are not in contact with each other. The first connection wiring 25 is disposed on the side opposite to the outer circumferential portion 22*b*. A second sacrifice conductor 72 corresponding to the inner magnetic path is disposed on the first sacrifice conductor 71 in the opening portion 42*a* of the second insulating layer 42. In this case, the via wiring 27, the second spiral wiring 22, the first connection wiring 25, and the second sacrifice conductor 72 can be disposed by the same process as the first spiral wiring 21, the second connection wiring 26, and the first sacrifice conductor 71.

Figure 3G:
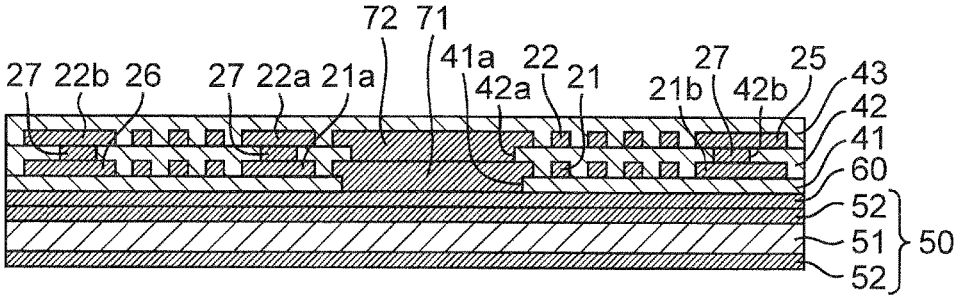
FIG. 3G is an explanatory view for explaining a manufacturing method of the inductor component.

As shown in FIG. 3G, the third insulating layer 43 is laminated to the second spiral wiring 22, the first connection wiring 25, and the second sacrifice conductor 72 to cover the second spiral wiring 22, the first connection wiring 25, and the second sacrifice conductor 72 with the third insulating layer 43. The third insulating layer 43 is thermally press-bonded and thermally cured by a vacuum laminator, a press machine, etc.

Figure 3H:
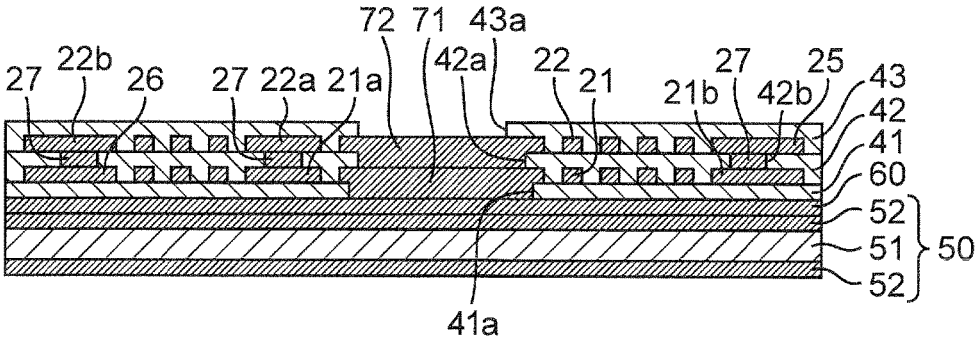
FIG. 3H is an explanatory view for explaining a manufacturing method of the inductor component.

As shown in FIG. 3H, a portion of the third insulating layer 43 corresponding to the inner magnetic path (magnetic core) is removed by a laser, etc., to form an opening portion 43*a*.

Figure 3I:
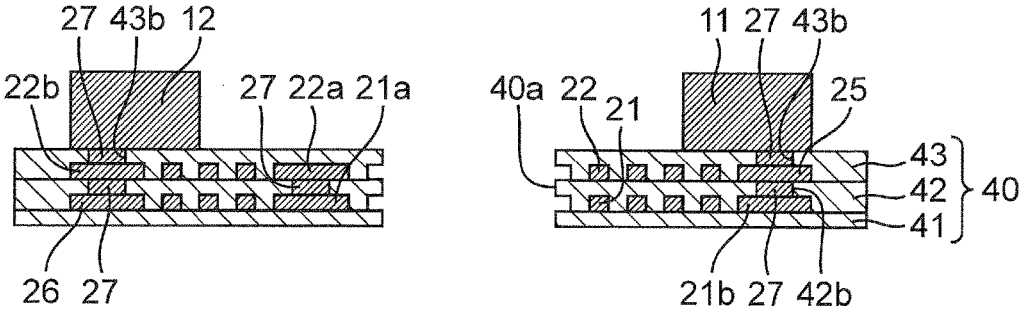
FIG. 3I is an explanatory view for explaining a manufacturing method of the inductor component.

Subsequently, the base 50 is peeled off from the dummy metal layer 60 on the bonding plane between the surface of the base 50 (the base metal layer 52) and the dummy metal layer 60. The dummy metal layer 60 is removed by etching, etc., and the first and second sacrifice conductors 71, 72 are removed by etching, etc., and as shown in FIG. 3I, a hole portion 40*a* corresponding to the inner magnetic path is disposed in the insulator 40. A via hole 43*b* for filling the via wiring 27 is then formed in the third insulating layer 43 by laser processing, etc. The via hole 43*b* is filled with the via wiring 27, and the columnar first and second internal electrodes 11, 12 are laminated on the third insulating layer 43. In this case, the via wiring 27 and the first and second internal electrodes 11, 12 can be disposed by the same process as the first spiral wiring 21.

Figure 3J:
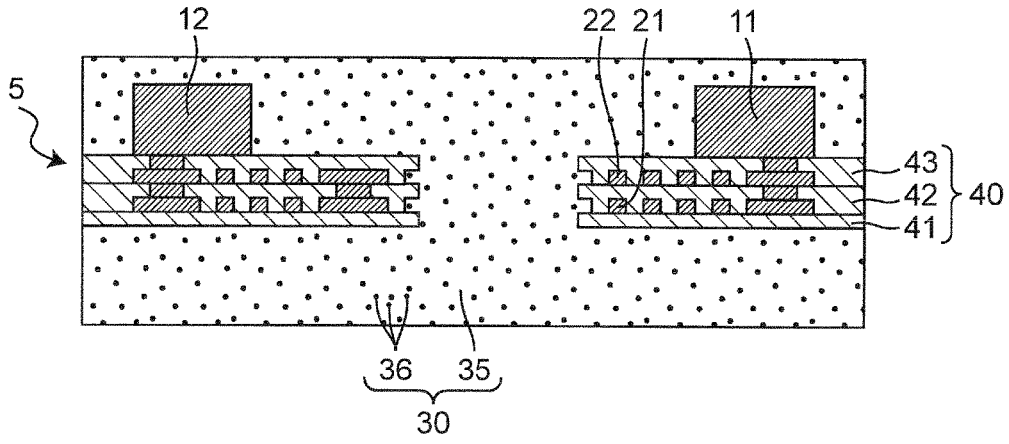
FIG. 3J is an explanatory view for explaining a manufacturing method of the inductor component.

As shown in FIG. 3J, the first and second internal electrode 11, 12 as well as the upper and lower surface sides of the insulator 40 are covered with the magnetic composite body 30 and the magnetic composite body 30 is thermally press-bonded and thermally cured by a vacuum laminator, a press machine, etc., to form the inductor substrate 5. In this case, the magnetic composite body 30 is also filled into the hole portion 40*a* of the insulator 40.

Figure 3K:
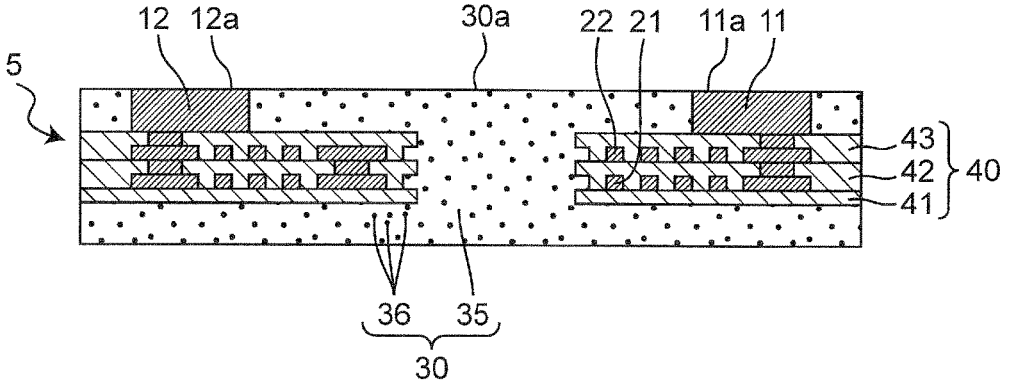
FIG. 3K is an explanatory view for explaining a manufacturing method of the inductor component.

As shown in FIG. 3K, the magnetic composite body 30 on the upper and lower sides of the inductor substrate 5 is reduced in thickness by a grinding method. In this case, the first and second internal electrodes 11, 12 are partially exposed so that the upper end surfaces 11*a*, 12*a* of the first and second internal electrodes 11, 12 are located on the same plane as the upper end surface 30*a* of the magnetic composite body 30. In this case, by grinding the magnetic composite body 30 to a thickness sufficient for acquiring an inductance value, the component can be made thinner. For example, in this embodiment, the thickness of the magnetic composite body 30 on the insulator 40 can be 20 μm. Additionally, by grinding the magnetic composite body 30, the metal magnetic powder 36 is exposed from the ground surface (the upper end surface 30*a*) of the magnetic composite body 30. In this case, the recesses 35*a* may be formed by shedding of particles of the metal magnetic powder 36 in a portion (the resin 35 portion) of the ground surface of the magnetic composite body 30.

Figure 3L:
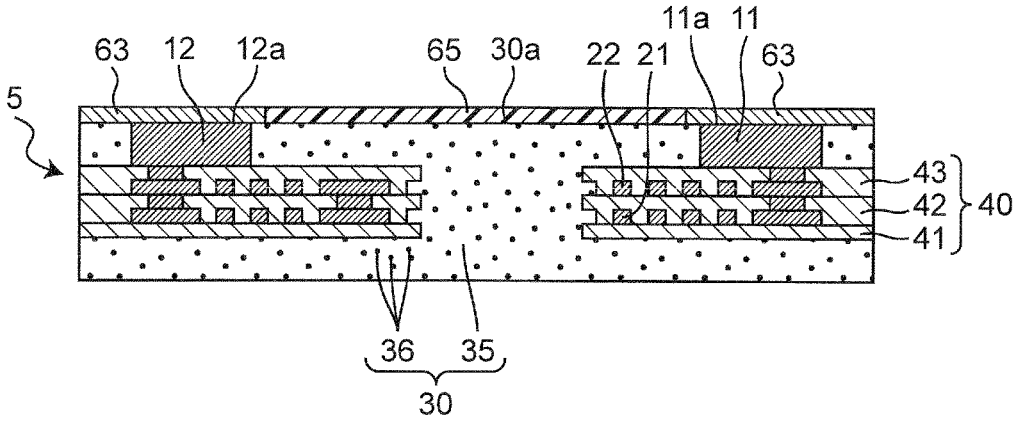
FIG. 3L is an explanatory view for explaining a manufacturing method of the inductor component.

As shown in FIG. 3L, the resin film 65 is formed by screen printing on the upper end surface 30*a* of the magnetic composite body 30. In this case, the resin film 65 is disposed with opening portions at positions corresponding to the external terminals 61, 62. The opening portions may be formed by photolithography, etc. The opening portions are arranged such that the upper end surfaces 11*a*, 12*a* of the internal electrodes 11, 12 are exposed. The metal films 63 are formed in the opening portions of the resin film 65 by electroless plating. The metal films 63 may be formed by sputtering, vapor deposition, electrolytic plating, etc.

Figure 3M:
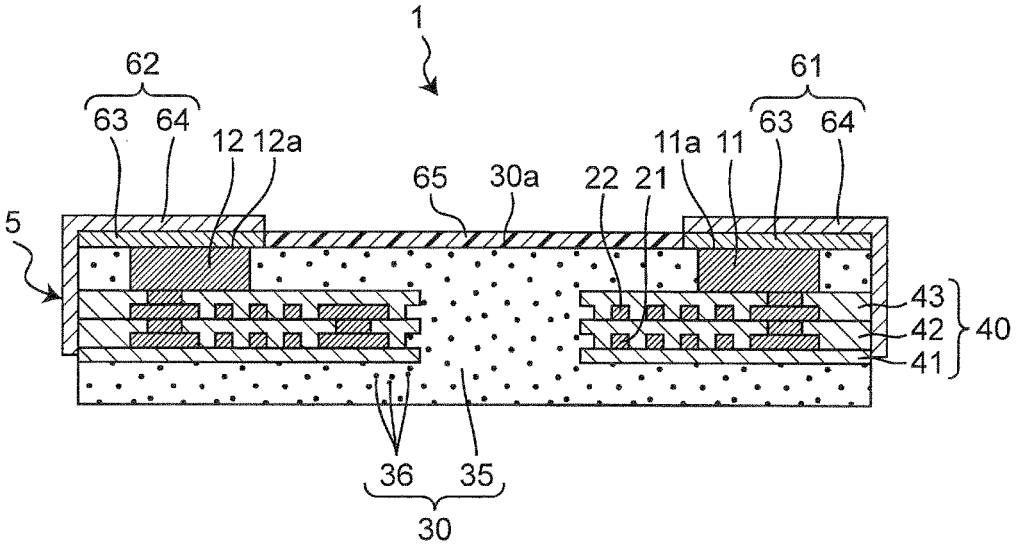
FIG. 3M is an explanatory view for explaining a manufacturing method of the inductor component.

Subsequently, as shown in FIG. 3M, the inductor substrate 5 is diced or scribed into pieces, and the coating films 64 are formed to cover the metal films 63, the wirings 21*b*, 22*b*, 25 to 27, and the internal electrodes 11, 12 so as to form the external terminals 61, 62. The coating films 64 are, for example, plating of NiSn, etc., formed by a method such as barrel-plating. As a result, the inductor component 1 is formed. In FIG. 3M, the positions of cutting into pieces are different as compared to FIG. 1. In this way, the inductor component 1 may have the side surfaces of the first and second internal electrodes 11, 12, the side surfaces of the via wirings 27, the side surfaces of the first and second connection wirings 25, 26, and the outer circumferential portions 21*b*, 22*b* of the first and second spiral wirings 21, 22 exposed as shown in FIG. 1, for example, or not exposed as shown in FIG. 3M, for example.

Although the inductor substrate 5 is formed on one of both surfaces of the base 50, the inductor substrate 5 may be formed on each of both surfaces of the base 50. Alternatively, pluralities of the first and second spiral wirings 21, 22 and the insulators 40 may be formed in parallel on one surface of the base 50 and may be separated into pieces at the time of dicing so that a multiplicity of the inductor substrates 5 can be formed at the same time. As a result, higher productivity can be achieved.

According to the inductor component 1, the external terminals 61, 62 include the metal films 63 contacting the resin 35 and the metal magnetic powder 36 of the magnetic composite body 30 as well as the upper end surfaces 11*a*, 12*a* of the internal electrodes 11, 12, and the areas of the metal films 63 on the upper end surface 11*a*, 12*a* side are larger than the areas of the upper end surfaces 11*a*, 12*a*. As a result, the exposed areas of the external terminals 61, 62 in the inductor component 1 can be made larger than the areas of the upper end surfaces 11*a*, 12*a*. Consequently, the areas of the external terminals 61, 62 bonded to solder can be made larger relative to the width of the inductor component 1 and, when the external terminals 61, 62 are bonded by solder, the posture of the inductor component 1 becomes stable so that the mounting stability of the inductor component 1 can be improved. The mounting stability is improved in this way without the need of increasing the areas of the upper end surfaces 11*a*, 12*a* of the internal electrodes 11, 12, and the magnetic composite body 30 can be restrained from being reduced in volume due to an increase in the cross-sectional areas of the internal electrodes 11, 12, so as to prevent characteristic degradation. The width of the inductor component 1 in this case is the width of the mounting surface of the inductor component 1 and refers to, for example, a length of a side of the principal surface on the side disposed with the metal film 63 (the surface of the inductor component 1 on the upper end surface 30*a* side). Specifically, for example, in FIG. 1, the width refers to a length of a side along a direction perpendicular to the plane of FIG. 1 on the principal surface of the inductor component 1 located on the upper side on the plane of FIG. 1.

Additionally, since the first and second internal electrodes 11, 12 are not brought into contact with the solder at the time of mounting, the solder leaching of the first and second internal electrodes 11, 12 can be suppressed.

For the external terminals 61, 62, etc., of the inductor component 1, a resin electrode film is often used that is applied by screen printing of a resin paste typically containing a metal powder of a conductor such as Cu. Therefore, the external terminals 61, 62 typically include resin electrode films in contact with the magnetic composite body 30. In this case, to ensure the adhesion between the resin electrode film and the composite body as well as the film strength and the conductivity of the resin electrode film itself, the film thickness of the resin electrode film must be made larger to some extent. However, since the inductor component 1 is strongly requested to have a lower height, a limitation is often imposed on the thickness of the external terminals 61, 62. Because of such a limitation on the film thickness, if the external terminals 61, 62 include the resin electrode films in the configuration of the inductor component 1, the adhesion, the film strength, and the conductivity may not sufficiently be ensured. In contrast, according to the inductor component 1, the external terminals 61, 62 include the metal films 63 in contact with the resin 35 and the metal magnetic powder 36 of the magnetic composite body 30. As compared to the resin electrode films, the metal films 63 have lower rates of decrease in the adhesion with the magnetic composite body 30 as well as the film strength and the conductivity of the metal films 63 themselves even when the film thickness is reduced. Therefore, the inductor component 1 can have the external terminals 61, 62 with the adhesion, the film strength, and the conductivity ensured while achieving a reduction in height.

Since the metal magnetic powder 36 has an average particle diameter of 5 μm or less, even when a high-frequency signal is applied to the inductor component 1, an eddy-current loss inside the metal magnetic powder 36 is made smaller so that a high frequency can be dealt with. When the average particle diameter of the metal magnetic powder 36 is as small as 5 μm or less, the surface roughness of the upper end surface 30*a* of the magnetic composite body 30 is reduced, resulting in a structure hardly producing the anchor effect between the external terminals 61, 62 and the magnetic composite body 30. However, the inductor component 1 includes the external terminals 61, 62 having the metal films 63 with the adhesion ensured as compared to the resin electrode films as described above, the external terminals 61, 62 can be restrained from peeling off.

Since the plurality of layers of the spiral wirings 11, 12 are alternately laminated with the plurality of the insulating layers 41 to 43 of the insulator 40, a glass epoxy substrate is not disposed and the thickness of the glass epoxy substrate can be removed to reduce the height. Since the insulating layers 41 to 43 of the insulator 40 are made of the composite material of the inorganic filler and the resin, no physical defect such as a crack is generated even when the insulating layers 41 to 43 are formed into thin films.

Since the metal magnetic powder 36 has an average particle diameter of 5 μm or less, the spiral wirings 11, 12 can be reduced in the wiring pitch and the inter-layer pitch and, additionally since the spiral wirings 11, 12 have the wiring pitch and the inter-layer pitch of 10 μm or less, a lower height and a smaller size can be achieved to, for example, a thickness of 0.33 mm or less so that the component can be built into an IC package substrate or mounted on the BGA side of the IC package substrate.

First Example

An example of the first embodiment will be described. The inductor component is intended to be used as a step-down switching regulator with a switching frequency of 100 MHz and is a power inductor having the size of 1 mm×0.5 mm and the thickness of 0.23 mm. The number of turns of the spiral wirings is 2.5 in a two-layer structure and the inductance value is about 5 nH at 100 MHz.

The winding number of the spiral wirings is set in accordance with the switching frequency such that a required inductance value is acquired. The winding number is set to 10 turns or less for a switching frequency of 40 MHz to 100 MHz.

The spiral wirings are shown as an example of L/S/t=70/10/70 μm, and L and t are set in accordance with a chip size and an allowable current applied to the inductor. The inter-layer pitch of the spiral wirings is the same as the wiring pitch, 10 μm, and since the wiring pitch and the inter-layer pitch of the spiral wirings are extremely narrowed to 10 μm or less, the spiral wirings are closely wound so that the inductor can be reduced in size and height.

(More Preferable Forms)

The inductor component 1 preferably has the metal films 63 formed by plating. Particularly, the metal films 63 are preferably formed by electroless plating and, in this case, the average particle diameter of crystals of the metal films 63 contacting the resin 35 is 60% or more and 120% or less of the average particle diameter of crystals of the metal films 63 contacting the metal magnetic powder 36. A state of the metal films 63 having a small difference in average particle diameter of crystals between on the metal magnetic powder 36 and on the resin 35 as described above corresponds to a state in which the metal films 63 with a comparatively small crystal particle diameter have been able to be formed on the resin 35.

Specifically, a metal film formed on the magnetic composite body by plating starts precipitating on the metal magnetic powder and gradually precipitates around the metal magnetic powder including on the resin. As described later, the average particle diameter of crystals of the metal film formed by plating becomes larger in a region of later precipitation than a region of earlier precipitation. Therefore, as in the metal films 63 in the preferable form described above, when a difference in average particle diameter of crystals is small between the metal films 63 contacting the metal magnetic powder 36, i.e., the metal films 63 precipitating earlier, and the metal films 63 contacting the resin 35, this corresponds to the fact that the metal films 36 have been able to be formed on the resin 35 in a comparatively early stage and that the metal films 63 with a comparatively small particle diameter have been able to be formed on the resin 35.

The adhesion between the metal films 63 and the resin 35 different in material is significantly affected by the anchor effect due to contact between the metal films 63 and the resin 35 along uneven areas. Since the metal films 63 in the preferable form described above have a small particle diameter of crystals, even when the resin 35 has slight unevenness, an interface can be formed along the unevenness. Therefore, the metal films 63 easily produce the anchor effect between the metal films 63 and the resin 35 so that the adhesion between the resin 35 and the metal films 63 can be improved. Thus, the adhesion on the resin 35 can be ensured to improve the adhesion of the entire metal films 63 to the magnetic composite body 30. Particularly, since the inductor component 1 has the metal magnetic powder 36 with the small average particle diameter of 5 μm or less resulting in a structure hardly producing the anchor effect as described above, the effect has a great influence. When the average particle diameter of the metal magnetic powder 36 is as small as 5 μm or less, since the metal magnetic powder 36 tends to shed particles during grounding of the upper end surface 30*a* of the magnetic composite body 30 and a rate of contact between the metal films 63 and the resin 35 is increased on the upper end surface 30*a*, the influence of the effect is further increased.

It is considered that when the metal films 63 are formed by using electroless plating, a difference in average particle diameter of the metal films 63 can be made smaller between on the metal magnetic powder 36 and on the resin 35 because of the following reason. Although barrel plating is generally employed for the inductor component 1, etc., from the viewpoint of manufacturing efficiency when electrolytic plating is performed, this leads to large variations in precipitation timing in portions of the formed metal films 63 including a portion on the resin 35 because timing of energization varies for each particle of the metal magnetic powder 36. In contrast, in electroless plating, the metal films 63 start precipitating on the metal magnetic powder 36 coming into contact with a plating solution and, since the particles of the metal magnetic powder 36 come into contact with the plating solution at relatively uniform timings, the precipitation timings can be made relatively uniform over the portions of the formed metal films 63. Since electroless plating makes the precipitation timings closer to each other in the portions of the metal films 63 in this way, the difference in average particle diameter of crystals of the metal films 63 can be made smaller between on the metal magnetic powder 36 and on the resin 35 as described above. Particularly, since the inductor component 1 has the metal magnetic powder 36 with the small average particle diameter of 5 μm or less and the resin 35 accounts for a large proportion on the upper end surface 30*a*, when the electrolytic plating is used, variations in the precipitation timing of the portions of the metal films 63 are made larger, and a difference from electroless plating becomes prominent.

In the case of a film formed by sputtering or vapor deposition, since it is considered that a difference in average particle diameter of crystals is not generated due to formation timing as in the plating, the same effect is difficult to produce. As compared to sputtering or vapor deposition, the metal films 63 formed by using plating have high adhesion to the metal magnetic powder 36 and, therefore, the plating is preferably used from the viewpoint of the adhesion of the entire metal films 63 to the magnetic composite body 30. Also from the viewpoints of equipment, processes, a formation time, high manufacturing efficiency such as the number of treatments, and low electric resistivity of the metal films 63, the plating is preferably used as compared to sputtering or vapor deposition.

A ratio of average particle diameters in this application is obtained by calculating an average particle diameter of crystals (particle aggregates) of the metal films 63 from an FIB-SIM image of a cross section of the metal films 63. The FIB-SIM image is a cross-sectional image observed by using an FIB (Focused Ion Beam) with an SIM (Scanning Ion Microscope). A method of calculating an average particle diameter may be a method including obtaining a particle size distribution from image analysis of the FIB-SIM image and determining a particle diameter at the integrated value of 50% (D50, median diameter) as the average particle diameter. However, since a ratio (relative value) rather than an absolute value of the average particle diameter is important, if the image analysis is difficult, a method may be used that includes measuring a plurality of maximum diameters of crystals of the metal films 63 as particle diameters in the FIB-SIM image and obtaining an arithmetic mean value thereof as the average particle diameter.

In the calculation, the number of crystals to be measured in terms of particle diameter may be about 20 to 50. The "crystals of the metal films 63 contacting the resin 35" and the "crystals of the metal films 63 contacting the metal magnetic powder 36" covered by the calculation are not strictly limited to the crystals directly contacting the resin 35 or the metal magnetic powder 36 and include crystals present within a range of about 1 μm from the interface between the metal films 63 and the resin material 35 or the interface between the metal films 63 and the metal magnetic powder 36 in the film thickness direction of the metal films 63. Although a relation of the ratio of the average particle diameter is preferably established in the entire metal films 63, the effect is produced even when the relation is established in a portion of the metal films 63. Therefore, the average particle diameter may be calculated from an FIB-SIM image of a portion of the metal films 63 or may be calculated from an FIB-SIM image within a range of about 5 μm in the direction along the upper end surface 30*a*, for example.

Electroless plating can reduce the unevenness in film thickness of the metal films 63 because of the precipitation timing described above. In contrast, the electrolytic plating makes the film thickness of the metal films 63 on the resin 35 smaller than the film thickness of the metal films 63 on the metal magnetic powder 36. If the thinnest portions of the films are made uniform in thickness, the metal films 63 with reduced unevenness can have the thickest portions of the films made thinner as compared to films with severe unevenness and can consequently have a smaller film thickness.

Preferably, a portion of the film thickness of the metal films 63 on the metal magnetic powder 36 is equal to or less than the film thickness of the metal films 63 on the resin 35. As a result, the unevenness in the inductor component 1 can be reduced. Particularly, since the metal films 63 constitute the external terminals 61, 62, the mounting stability and the reliability are improved.

Preferably, the metal magnetic powder 36 is made of metal or alloy containing Fe, and the metal films 63 are made of metal or alloy containing Cu. In this case, by grinding the upper end surface 30*a* of the magnetic composite body 30, the metal magnetic powder 36 containing Fe baser than Cu can be exposed on the upper end surface 30*a*. Immersion of the upper end surface 30*a* into an electroless plating solution containing Cu causes precipitation of Cu displacing Fe, and the plating subsequently grows due to the effect of a reducing agent contained in the electroless plating solution, so that the metal films 63 containing Cu can be formed. As a result, the metal films 63 can be formed by electroless plating without using a catalyst. Since the metal films 63 are made of metal or alloy containing Cu, the conductivity can be improved.

Preferably, the film thickness of the metal films 63 on the metal magnetic powder 36 is 60% or more and 160% or less of the film thickness of the metal films 63 on the resin 35. As a result, the film thickness of the metal films 63 becomes uniform. Therefore, the unevenness in the inductor component can be reduced. Particularly, when the metal films 63 constitute the external terminals 61, 62, the mounting stability and the reliability are improved. The film thickness may be calculated from the image analysis, or may directly be measured, in the FIB-SIM image of the metal films 63, for example. Although the relation of the ratio of the film thickness is preferably established in the entire metal films 63, the effect is produced even when the relation is established in a portion of the metal films 63. Therefore, the film thickness may be calculated from an FIB-SIM image of a portion of the metal films 63 or may be calculated from an FIB-SIM image within a range of about 5 μm in the direction along the upper end surface 30*a*, for example, or the film thicknesses measured at several positions (e.g., five positions) each on the resin 35 and the metal magnetic powder 36 may be compared. In comparison of the film thicknesses, preferably, the comparison is made between the average values of the respective film thicknesses on the resin 35 and on the metal magnetic powder 36.

Pd may exist in the interface between the metal magnetic powder 36 and the metal films 63 and, therefore, the metal films 63 may be formed by electroless plating by using Pd as a catalyst. With this method, even if the metal films 63 are baser than the metal magnetic powder 36, for example, if the metal magnetic powder 36 is made of metal or alloy containing Cu and the metal films 63 are made of metal or alloy containing Ni, a displacement Pd catalyst treatment can be performed to form the metal films 63 by using electroless plating. Therefore, in this case, a degree of freedom is improved in terms of material selection for the metal magnetic powder 36 and the metal films 63.

Figure 4:
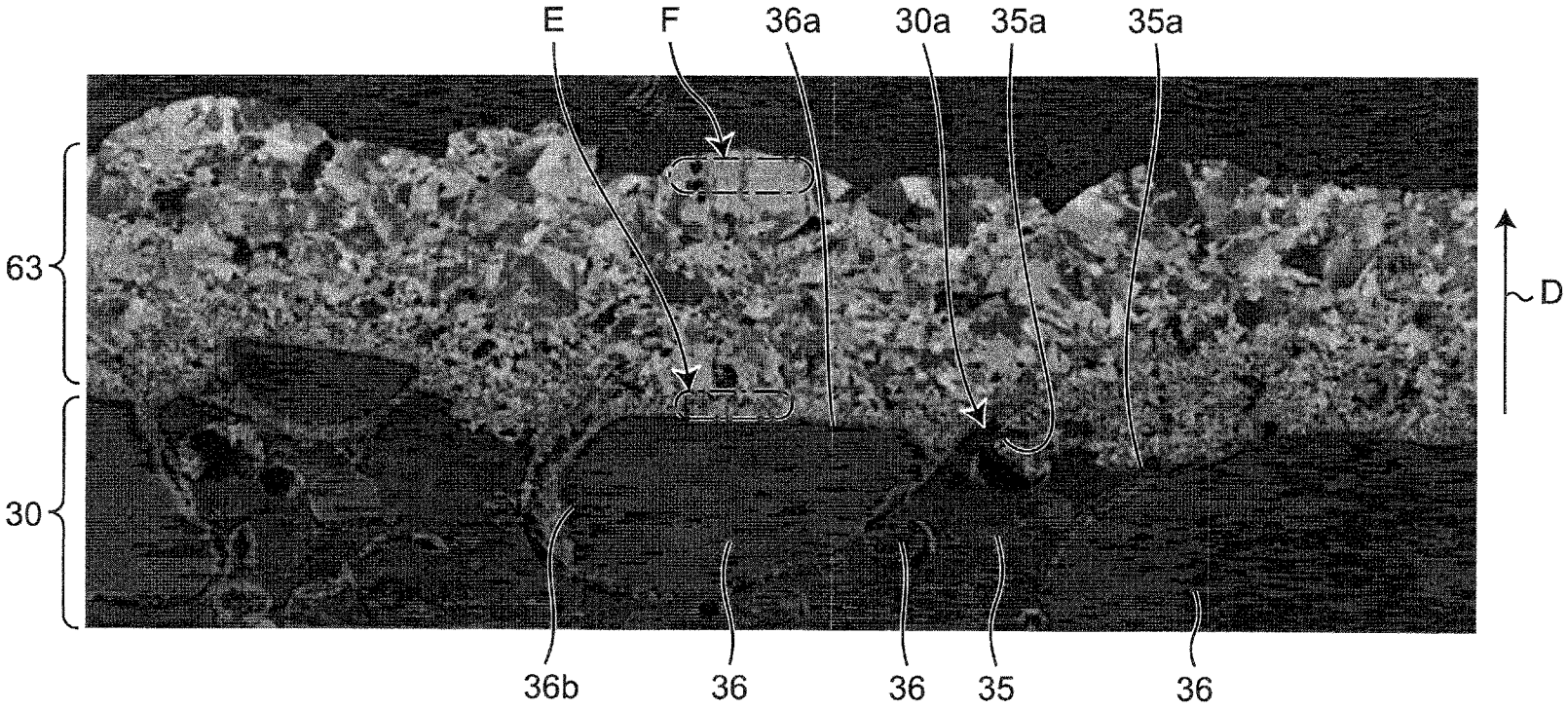
FIG. 4 is a cross-sectional image of a first example of the inductor component.
Figure 5:
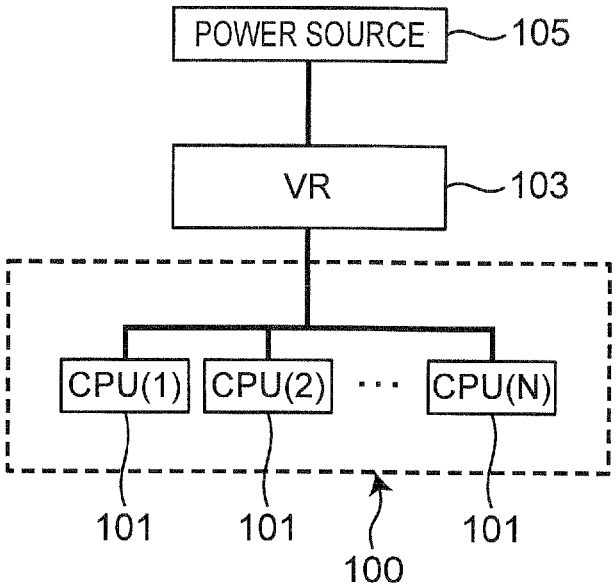
FIG. 5 is a simplified configuration diagram of a conventional system.
Figure 6:
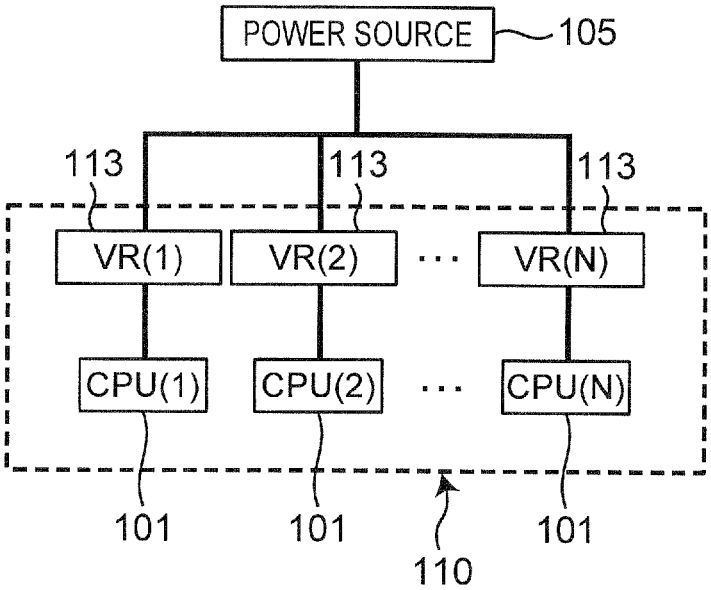
FIG. 6 is a simplified configuration diagram of an IVR system.

FIG. 4 shows a cross-sectional image of an example of the inductor component. FIG. 4 shows an FIB-SIM image when the metal film 63 is formed on the magnetic composite body 30 by using electroless plating. As shown in FIG. 4, when the film is formed by using electroless plating, it can be seen that a portion of the metal film 63 goes around along the outer surface of the metal magnetic powder 36 to the inner side of the magnetic composite body 30. Specifically, as indicated by a light-colored portion extending along the outer surface of the metal magnetic powder 36 of FIG. 4, the metal film 63 has penetrated along the outer surface of the metal magnetic powder 36 into a gap between the resin 35 and the metal magnetic powder 36. In particular, the metal film 63 has precipitated not only on an exposed surface 36*a* exposed from the resin 35 of the metal magnetic powder 36 but also on a contained surface 36*b* contained in the resin 35 of the metal magnetic powder 36. Therefore, by forming the metal film 63 by using electroless plating, a portion of the metal film 63 goes around along the outer surface of the metal magnetic powder 36 to the inner side of the magnetic composite body 30 and the anchor effect is improved as described above.

As shown in FIG. 4, a crystal particle diameter of the metal film 63 formed by using plating is made larger from the side contacting with the metal magnetic powder 36 toward the opposite side thereof (in the direction of an arrow D). In particular, it can be seen that the crystal particle diameter of the metal film 63 away from the magnetic composite body 30 (a portion F of FIG. 4) is larger than the crystal particle diameter of the metal film 63 contacting with the magnetic composite body 30 (a portion E of FIG. 4). In this way, the metal film 63 formed by using plating becomes larger in a region of later precipitation than a region of earlier precipitation.

The present disclosure is not limited to the embodiment described above and may vary in design without departing from the spirit of the present disclosure.

Although the magnetic composite body indirectly covers the spiral wirings via the insulator in the embodiment, the magnetic composite body may directly cover the spiral wiring. In this case, the magnetic composite body includes a plurality of composite layers, and the plurality of layers of the spiral wirings and the plurality of composite layers are alternately laminated. As a result, no physical defect such as a crack is generated even when the composite layers are formed into thin films, and the sufficient strength can be retained even without disposing a glass epoxy substrate, so that the thickness of the glass epoxy substrate can be removed to reduce the height.

Although the two layers of the spiral wirings are included in the embodiment, the inductor component may include three or more layers of spiral wirings.

Although the number of inductors made up of the plurality of layers of the spiral wirings is one in the embodiment, the number of inductors included in the inductor component is not limited to one. For example, a plurality of inductors may be made up of a spiral wiring having a plurality of spirals on the same plane.

The invention claimed is:

1. An inductor component comprising:

a plurality of layers of spiral wirings;

a magnetic composite body directly or indirectly covering the plurality of layers of spiral wirings and made of a composite material of a resin and a metal magnetic powder with an average particle diameter of 5 μm or less;

an internal electrode embedded in the magnetic composite body with an end surface exposed from an outer surface of the magnetic composite body, the internal electrode being electrically connected to the spiral wirings; and an external terminal disposed on the outer surface of the magnetic composite body and electrically connected to the internal electrode, wherein the external terminal includes a metal film contacting the resin and the metal magnetic powder of the magnetic composite body as well as the end surface of the internal electrode, the metal film has an area on a side facing the end surface larger than an area of the end surface, the metal film has a portion formed in a gap between an outer surface of the metal magnetic powder and a surface of the resin extending around the outer surface of the metal magnetic powder, and the portion in the gap directly contacts the outer surface of the metal magnetic powder and the surface of the resin.

2. The inductor component according to claim 1, wherein a thickness of the metal film is equal to or less than ⅕ of a thickness of the spiral wirings.

3. The inductor component according to claim 1, wherein a thickness of the metal film is 1 μm or more and 10 μm or less.

4. The inductor component according to claim 1, wherein a material of the metal film and a material of the internal electrode are a same kind of metal.

5. The inductor component according to claim 1, wherein the magnetic composite body has a recess in a portion of the outer surface, and the metal film is filled into the recess.

6. The inductor component according to claim 1, wherein the metal film goes around along an outer surface of the metal magnetic powder to an inner side of the magnetic composite body.

7. The inductor component according to claim 1, wherein a particle diameter of crystals of the metal film increases from a side contacting with the magnetic composite body toward an opposite side.

8. The inductor component according to claim 1, wherein the external terminal includes a coating film, wherein the coating film covers the metal film.

9. The inductor component according to claim 8, wherein the metal film of each of a plurality of external terminals is disposed on a first surface of the magnetic composite body, and a resin film is disposed on a portion without the metal film on the first surface of the magnetic composite body.

10. The inductor component according to claim 9, wherein the external terminal is protruded further than the resin film to the side opposite to the first surface.

11. The inductor component according to claim 9, wherein the resin film contains a filler made of an insulating material.

* * * * *